US005435111A

United States Patent [19]

Cox et al.

[11] Patent Number: 5,435,111

[45] Date of Patent: Jul. 25, 1995

[54] CONNECTING DEVICE

[75] Inventors: Christopher V. Cox, Farnham; Luke R. J. Whale, Alton; Alan P. Shuttle; Leonard M. Beale, both of Farnham, all of England

[73] Assignee: GNS UK Limited, Aldershot, England

[21] Appl. No.: 206,899

[22] Filed: Mar. 4, 1994

Related U.S. Application Data

[63] Continuation of Ser. No. 927,674, Oct. 16, 1992.

[30] Foreign Application Priority Data

Mar. 12, 1990 [GB] United Kingdom ..... 9005507
Sep. 7, 1990 [GB] United Kingdom ..... 9019595

[51] Int. Cl.[6] ..... E04B 1/38; E04B 2/74

[52] U.S. Cl. ..... 52/713; 52/481.2; 52/489.2; 52/511

[58] Field of Search ..... 52/481, 483, 486, 487, 52/488, 489, 765, 775, 511, 481.1, 489.1, 489.2, 775, 481.2, 713

[56] References Cited

U.S. PATENT DOCUMENTS

| | | | |
|---|---|---|---|
| 2,339,841 | 1/1944 | Deuchler et al. | 52/489.2 |
| 2,864,472 | 12/1958 | Fernberg | 52/511 |
| 3,686,810 | 8/1972 | Allen | 52/481.2 |
| 3,705,471 | 12/1972 | Allen | 52/481.2 |
| 3,753,325 | 8/1973 | Stanley et al. | 52/489 |
| 3,948,011 | 4/1976 | Price et al. | 52/481.2 |
| 3,998,018 | 12/1976 | Hodges | 52/481 |
| 4,245,448 | 1/1981 | Agar | 52/489 |
| 4,928,467 | 5/1990 | Hintsa | 52/511 |

FOREIGN PATENT DOCUMENTS

| | | |
|---|---|---|
| 1002279 | 12/1976 | Canada . |
| 1044870 | 12/1978 | Canada . |
| 2434905 | 3/1980 | France . |
| 966362 | 8/1964 | United Kingdom . |
| 1072472 | 6/1967 | United Kingdom . |
| 1439018 | 6/1976 | United Kingdom . |
| 1600887 | 10/1981 | United Kingdom . |

*Primary Examiner*—Michael Safavi
*Attorney, Agent, or Firm*—Leydig, Voit & Mayer, Ltd.

[57] ABSTRACT

The invention provides a connecting device for releasably connecting two objects, comprising a base plate fixedly attachable to the first of the objects and at least one projection extending therefrom so as to cooperate with receiving means located on the second object, characterised in that the projection is releasably mounted on the base plate via interengaging means. This arrangement allows accurate and secure alignment of the base plate at any convenient time up to connection of the two objects, particularly during formation or immediately after formation of the first object. The projection can be attached at any subsequent convenient time which means that the first object can be stored, transported and handled without the projection attached. This makes storage, transportation and handling easy and economical. The connecting device is particularly suitable for mounting cladding panels on a framework.

10 Claims, 2 Drawing Sheets

FIG.1.
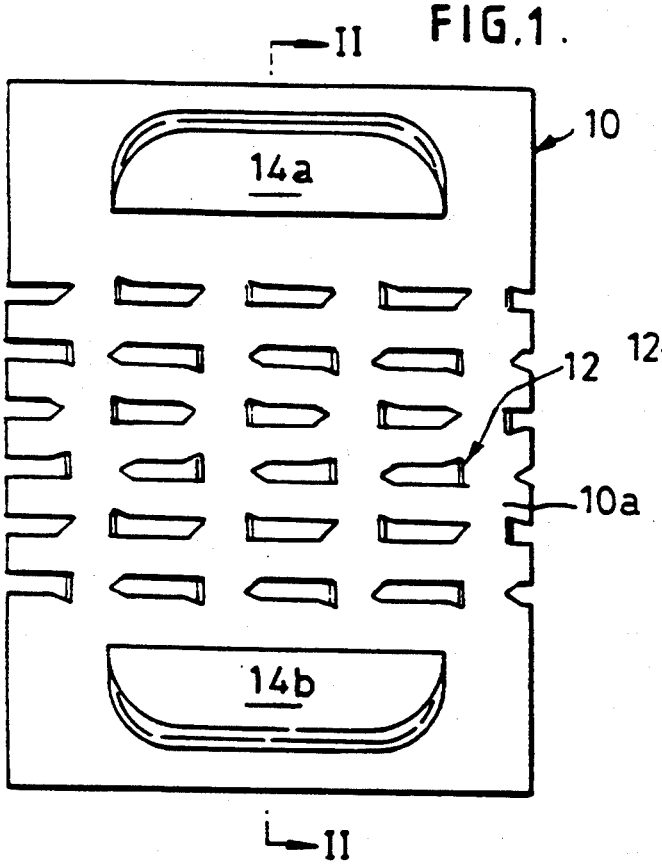
FIG.2.
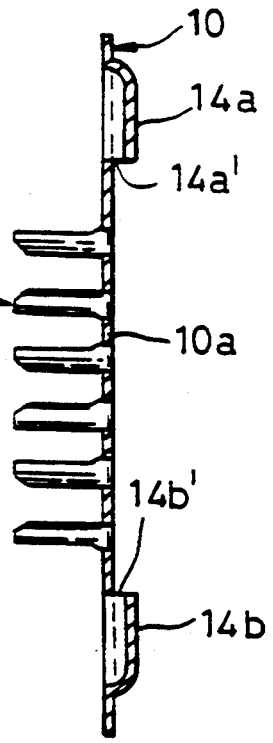
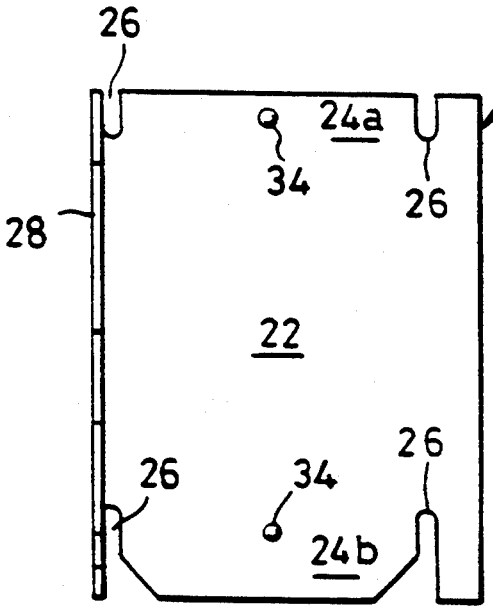
FIG.3.
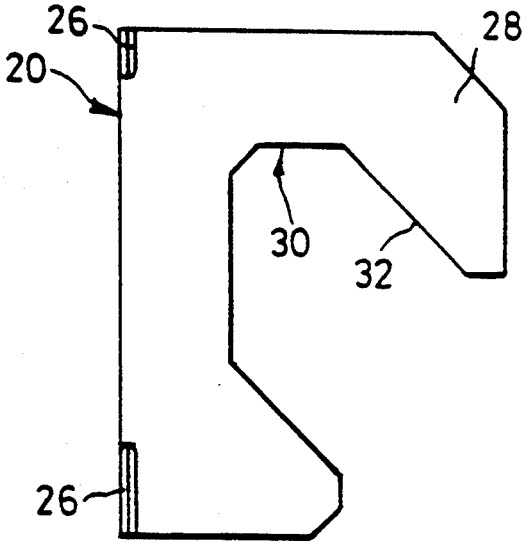
FIG.4.

CONNECTING DEVICE

This is a continuation of copending application Ser. No. 07/927,674 filed on Oct. 16, 1992.

The invention relates to a connecting device, particularly but not exclusively to a device for connecting cladding panels to framework to form demountable partitioning.

Some known connectors suffer from the disadvantage that the cladding panels cannot be fitted closely to the supporting framework. Other known connectors require to be fixed to the panels on site and this can result in misalignment of the connectors with respect to the framework.

It is an object of the present invention to provide a connector which is cheap and simple to produce and enables a panel to be fitted closely to supporting framework. It is a further object of the invention to provide a connector which can be fixedly attached to a panel in accurate alignment easily and cheaply. A further object is to provide a connector which can be used with all known systems of cladding and framework.

The invention provides a connecting device for releasably connecting a panel to a framework, comprising a substantially planar base plate and a hook member releasably connectable thereto, the base plate being fixedly attachable to the panel by means of gang nails and the hook member being adapted to releasably engage the framework, characterised in that the base plate comprises a central portion and two end portions, at least some of the said gang nails being located in the central portion and a channel being located in each of the end portions, each channel being adapted to receive one of two tongues located on the hook member. This arrangement allows accurate alignment of the base plate at any convenient time up to connection of the panel and framework, particularly during formation or immediately after formation of the panel. The hook member can be attached at any subsequent convenient time which means that the panel can be stored, transported and handled without the hook member attached. This makes storage, transportation and handling easy and economical. Preferably, all of the gang nails are located in the central portion.

Preferably, the channels are formed by pressing and each tongue may have a protruding deformation to facilitate holding of the said tongue in the respective channel. The hook member is preferably adapted so as to facilitate accurate and secure location of the panel and framework with respect to one another. Any profile that achieves a suitable locating action may be employed, but an inverted V-shaped or diamond-shaped profile is preferred to a curved profile. Particularly, the hook member may be adapted to move the panel towards the framework upon cooperation of the hook member with the framework. The arrangement enables a panel to be fitted closely, accurately and easily to the supporting framework.

In a preferred embodiment, the hook member comprises a connecting plate carrying the two said tongues, and a hooking portion projecting outwardly from the connecting plate, the hooking portion being plate-like in form.

It will be appreciated that in its preferred construction the connector lends itself to being fabricated as simple sheet metal pressings. However, the connector portions may also be fabricated by any other suitable means, such as moulding from a suitable plastics or composite material.

The invention also provides a method of releasably connecting a panel and a framework utilising a connecting device as claimed in any one of the preceding claims, comprising steps of:

(a) fixedly attaching the base plate of the connecting device to the panel either during or after formation of the panel;

(b) transporting the panel to the site of use;

(c) releasably securing the hook member to the base plate; and (d) bringing the hook member into cooperation with the framework. Preferably, the base plate is attached to the panel before the panel is transported to the site of use.

An embodiment of the present invention will now be described with reference to the accompanying drawings wherein;

FIG. 1 a plan view of a base plate of a connecting device according to the invention;

FIG. 2 is a sectional view taken along the line II—II in FIG. 1;

FIG. 3 is a plan view of a projection of a connecting device according to the invention;

FIG. 4 is a side view of the hook member according to FIG. 3; and

Figure 5:
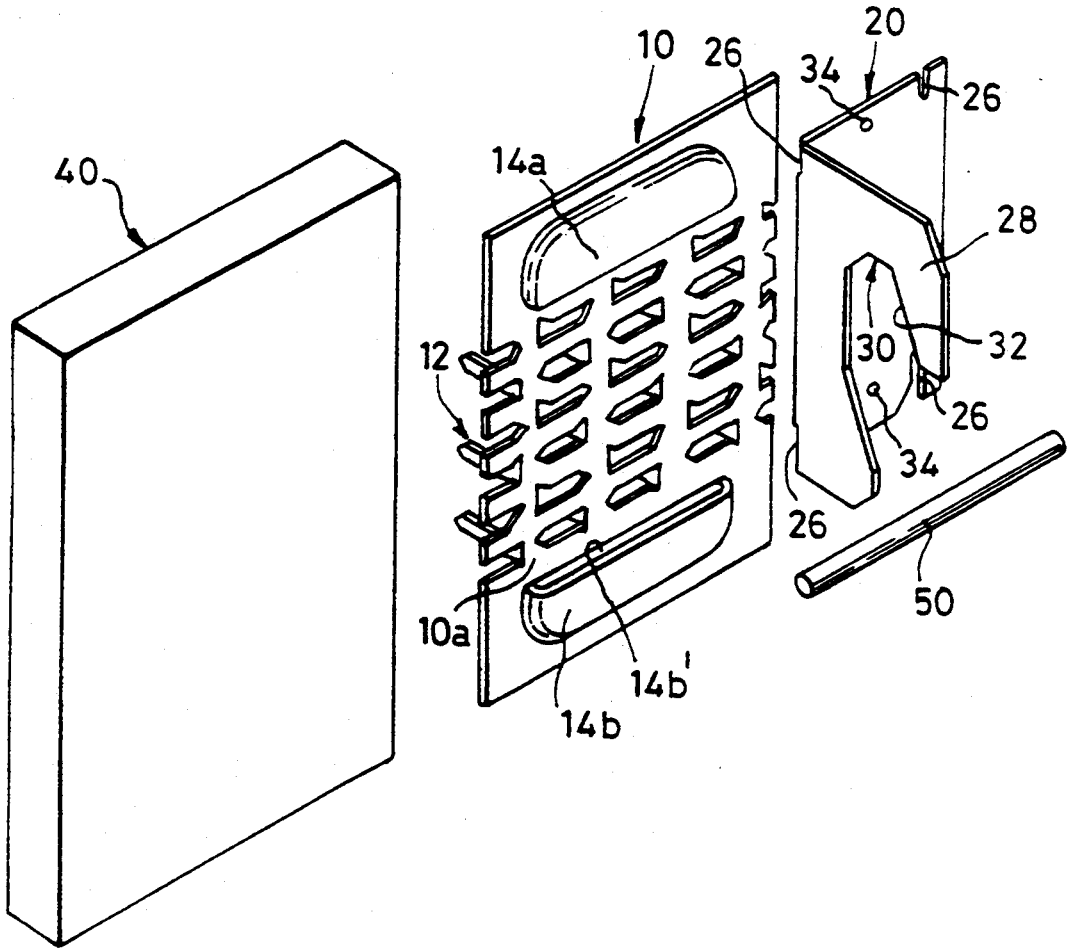
FIG. 5 is an exploded perspective view illustrating a preferred use of the connecting device of FIGS. 1 to 4.

In the drawings, FIGS. 1 and 2 show a base plate 10 forming part of a connecting device according to the invention. The base plate 10 is generally planar and has a central section 10*a* which has been punched to form a series of metal prongs 12 or gang nails. These prongs 12 allow the base plate 10 to be fixedly attached to a panel, for example, a plasterboard panel.

Adjacent either end of the base plate 10 are located channels 14*a* and 14*b*. The channels 14*a* and 14*b* are formed by pressing a portion of the base plate adjacent a transverse cut therein out of the plane of the rest of the base plate 10.

FIGS. 3 and 4 illustrate a hook member 20 which is used in conjunction with the base plate of FIGS. 1 and 2. The hook member 20 consists of a connecting plate 22 having longitudinally extending tongues 24*a* and 24*b* at either end thereof. Slots 26 define the transverse edges of the tongues 24*a* and 24*b*. One side of the connecting plate is connected to a hooking portion 28 which extends perpendicularly from the connecting plate 22. The hooking portion 28 has a generally diamond-shaped recess 30 having an upper edge 32 inclined toward the connecting plate 22. The tongues 24*a* and 24*b* also carry protruding deformations 34 whose function will be described below. Both the base plate 10 and the hook member 20 are pressed from sheet steel blanks.

A method of utilising the connecting device described above will now be described with reference to FIG. 5. It is envisaged that this type of connecting device will be utilised in the releasable connection of a cladding panel to a framework comprising horizontal tubular members. The prongs or gang nails 12 are initially forced into the inner surface of the cladding panel 40 in order to fixedly attach the base plate 10 thereto. Advantageously, this step is carried out before the cladding panel is transported to its on site location in order that accurate alignment of a series of base plates required to be attached to the panel can be carried out either during production of the panel or shortly thereafter. The base plate 10 can be affixed to the cladding panel 40 by any appropriate method. At this stage, the hook member 20 is not attached to the base plate 10 in order to facilitate transportation of the panel 40 to the on site location.

When the cladding panel 40 is required to be releasably attached to the framework, a hook member 20 is attached to the base plate, or to each base plate if more than one such plate is provided on the cladding panel. This is carried out by inserting the lower tongue **24*b* fully into the lower channel 14*b* and subsequently inserting the upper tongue 24*a* into the upper channel 14*a*. It will be noted that the upper tongue 24*a* is of a shorter length than the tongue 24*b*. The relative lengths are such that, when the upper tongue 24*a* is fully inserted into the upper channel 14*a*, the lower tongue 24*b* remains engaged with the lower channel 14*b*. Only by inserting the lower tongue 24*b* fully into the lower channel 14*b* can the hook member 20 be removed from the base plate 10. The slots 26 are engaged with the walls of the channels 14*a* and 14*b* when the hook member portion 20 is connected to the base plate 10 to reduce lateral play of the tongues 24*a* and 24*b* in the channels 14*a* and 14*b***.

The channels **14*a* and 14*b* have openings 14*a*' and 14*b*' which are marginally wider than the width of the material of the tongues 24*a* and 24*b*. The protruding deformations reduce the amount of play between the tongues 24*a* and 24*b* and the channels 14*a* and 14*b***.

Once the hook member 20 has been connected to the base plate, the substantially diamond-shaped recess 30 can be used as locating means to locate the cladding panel 40 on the supporting framework 50. The inclined surface 32 encourages the framework 50 to be located at the upper end of the recess 30 or until the panel 40 abuts vertical portions of the framework without further guiding means being necessary. The weight of the cladding panel 40 maintains the upper tongue **24*a* of the hook member 20 in an uppermost position in the upper channel 14*a* of the base plate 10 wherein the base plate 10 and the hook member 20** cannot become detached.

Clearly, it is a simple matter for the cladding panel 40 to be removed from the framework 50 for any reason whatsoever, for example, to provide access to a void in the partition to allow the installation or maintenance of services such as electrical or data wiring or to relocate the entire partition. The panel merely has to be lifted so as to disengage the hook member 20 from the framework 50 and the panel 40 becomes freely moveable. However, this releasing of the panel does not in any way render useless the components of the connecting device. The panel 40, base plate 10 and hook member 20 can be re-used elsewhere as desired.

The above described embodiment is not intended to be limitative. It is envisaged that various modifications and alterations could be made to the described connecting device without departing from the scope of the invention. For example, the channels may be arranged longitudinally of the base plate or at any other convenient angle. Further gang nails may be provided in the end portions of the base plate if desired.

It is also envisaged that more than one hooking portion could be provided on the connector plate. For example, a second hooking portion 28 could be provided on the right side of the connector plate as viewed in FIG. 3. This would be advantageous when the panel to be supported is particularly massive or likely to be put under considerable loading. Alternatively, separate interengaging means could be provided on the base plate for receiving a second hook member.

A connecting device according to the present invention is not limited in its application to connecting cladding panels to a framework. Many other uses are envisaged in any situation where an object is desired to be connected to another object in a releasable manner. Also, the design of the hooking portion can be varied so as to provide other types of connection. A sprung clip could, for example, be incorporated into the projection.

We claim:

1. A connecting device for releasably connecting a panel to a framework, the connecting device comprising a substantially planar base plate and a hook member, the hook member being vertically translatable relative to the base plate and including a connecting plate having lower and upper tongues received by respective lower and upper channels of the base plate for connecting the base plate to the hook member; the base plate including fasteners for fixedly attaching the base plate to the panel and the hook member having a hook portion projecting from the connecting plate and shaped to releasably engage the framework, the base plate having a central portion and opposing end portions; at least some of the fasteners being located in the central portion; the connecting plate of the hook member having a length sufficient to span and simultaneously engage the upper and lower channels of the base plate, the lower channel of the base plate having a length sufficient to receive the lower tongue of the hook member when the upper tongue is free from the upper channel of the base plate.

2. A connecting device as claimed in claim 1, wherein all of the fasteners are located in the central portion of the base plate.

3. A connecting device as claimed in claim 1 wherein the upper and lower channels are formed by pressing.

4. A connecting device as claimed in claim 1, wherein the lower and upper tongues of the connecting plate each includes a protruding deformation to facilitate holding the lower and upper tongues in the lower and upper channels of the base plate.

5. A connecting device as claimed in claim 1, wherein the hooking portion of the hook member defines a substantially diamond shaped recess for facilitating accurate and secure location of the panel and framework with respect to one another.

6. A connecting device as claimed in claim 1, wherein the hooking portion of the hook member includes an upper edge inclined toward the base plate for moving the panel towards the framework upon cooperation of the hooking portion of the hook member with the framework.

7. A connecting device as claimed in claim 1 wherein the hooking portion of the hook member is plate-like in form.

8. A method of releasably connecting a panel and a framework utilizing a connecting device having a base plate and a detachable hook member comprising the steps of:

(a) fixedly attaching the base plate of the connecting device to the panel;

(b) transporting the panel to a site of use;

(c) releasably securing the hook member of the connecting device to the base plate by inserting a lower portion of the hook member into a lower channel defined in the base plate and then translating the hook member upwards relative to the base plate such that an upper portion of the hook member enters an upper channel defined in the base plate; and (d) bringing the hook member into cooperation with the framework such that the panel is suspended upon the framework thereby preventing the hook member from translating downward with respect to the base plate and securing the upper and lower portions of the hook member in the upper and lower channels of the base plate.

9. A method as claimed in claim 8, wherein the base plate is attached to the panel after the panel is transported to the site of use.

10. A connecting device for releasably connecting a panel to a framework, the connecting device comprising a substantially planar base plate having upper and lower end portions separated by a central portion, the central portion having gang nails for securing the base plate to the panel, the upper end portion having an upper channel including a horizontal, downwardly oriented opening and the lower end portion having a lower channel having (1) a length and (2) a horizontal, upwardly oriented opening substantially aligned with the downwardly oriented opening of the upper channel but separated therefrom by a distance; and, a hook member for attaching the base plate to the framework, the hook member having (1) a connecting plate including opposing upper and lower tongues disposed within the upper and lower channels of the base plate, respectively, and (2) a substantially planar hooking portion projecting outwardly from the connecting plate for securing the hook member to the framework, the hook member having a length greater than the distance between the opposing openings of the base plate for simultaneously engaging the upper and lower channels but shorter than a combined length of the distance between the opposing openings and the length of the lower channel for freeing the upper tongue from the upper channel without removing the lower tongue from the lower channel.

* * * * *